US009284750B2

(12) United States Patent
Maeng et al.

(10) Patent No.: US 9,284,750 B2
(45) Date of Patent: Mar. 15, 2016

(54) DOOR MORTISE LOCK

(71) Applicant: SAMSUNG SNS CO., LTD., Seoul (KR)

(72) Inventors: Chul-Ho Maeng, Anyangsi (KR); Young-Kwon Kim, Yangju-si (KR)

(73) Assignee: SAMSUNG SDS CO., LTD. (KR)

( * ) Notice: Subject to any disclaimer, the term of this patent is extended or adjusted under 35 U.S.C. 154(b) by 305 days.

(21) Appl. No.: 13/871,269

(22) Filed: Apr. 26, 2013

(65) Prior Publication Data

US 2014/0252780 A1 Sep. 11, 2014

(30) Foreign Application Priority Data

Mar. 11, 2013 (KR) ..... 10-2013-0025877

(51) Int. Cl.

| | |
|---|---|
| ***E05C 1/06*** | (2006.01) |
| ***E05B 59/00*** | (2006.01) |
| ***E05B 47/00*** | (2006.01) |
| ***E05B 55/00*** | (2006.01) |
| *E05C 9/12* | (2006.01) |

(52) U.S. Cl.

CPC ..... *E05B 59/00* (2013.01); *E05B 47/00* (2013.01); *E05B 47/0012* (2013.01); *E05B 55/00* (2013.01); *E05B 2047/0021* (2013.01); *Y10T 292/0964* (2015.04)

(58) Field of Classification Search

CPC ..... E05B 55/00; E05B 59/00; E05B 47/00; E05B 47/0012; E05B 2047/0021

USPC ..... 292/2, 3, 32–34, 36, 37, 39, 40, 137, 292/156, 158–160, 163, 165, 167, 169, 292/169.13, 169.14, 169.16, 169.17, 292/169.21, 169.22, 172, 173, 139, 140, 292/142, 143, 144; 70/106, 107, 110, 129, 70/224, 277, 278.1, 278.2, 278.3, 278.7, 70/279.1, 282, 283.1

See application file for complete search history.

(56) References Cited

U.S. PATENT DOCUMENTS 1,659,169 A * 2/1928 Segal ..... 70/107
4,833,465 A * 5/1989 Abend et al. ..... 340/5.65

(Continued)

FOREIGN PATENT DOCUMENTS

DE 3407073 A1 * 8/1985
EP 378758 A2 * 7/1990

(Continued)

OTHER PUBLICATIONS

Korean Office Action—Korean Application No. 10-2013-0025877 issued on Aug. 22, 2014, citing KR 10-1184346 and KR 10-2011-0096744.

*Primary Examiner* — Alyson M Merlino
(74) *Attorney, Agent, or Firm* — Cantor Colburn LLP

(57) ABSTRACT

Provided is a door mortise lock that may improve product safety and user convenience by enabling a latch bolt operates to be unlocked after a dead bolt of the door mortise lock completely operates. To this end, the door mortise lock includes: a dead bolt driving unit that operates a dead bolt; a latch bolt driving unit that unlocks a latch bolt when a time interval passes after the dead bolt is unlocked by the dead bolt driving unit; and a connection unit that is disposed between the dead bolt driving unit and the latch bolt driving unit, and selectively operates the dead bolt driving unit and the latch bolt driving unit so that the dead bolt and the latch bolt are sequentially unlocked with a time interval.

7 Claims, 3 Drawing Sheets

(56) References Cited

U.S. PATENT DOCUMENTS

| | | | | | |
|---|---|---|---|---|---|
| 4,962,653 | A * | 10/1990 | Kaup | 70/107 | |
| 5,044,184 | A * | 9/1991 | Herbers et al. | 70/277 | |
| 5,083,448 | A * | 1/1992 | Karkkainen et al. | 70/277 | |
| 5,265,920 | A * | 11/1993 | Kaup | E05B 63/0021 | 292/40 |
| 5,865,920 | A * | 2/1999 | Sakuratani et al. | 156/89.16 | |
| 6,138,485 | A * | 10/2000 | Fuss et al. | 70/107 | |
| 6,899,361 | B2 * | 5/2005 | Dorn | 292/332 | |
| 2006/0191303 | A1 * | 8/2006 | Shvarts | 70/107 | |
| 2007/0113603 | A1 * | 5/2007 | Polster | 70/107 | |
| 2011/0175373 | A1 * | 7/2011 | Ding et al. | 292/144 | |

FOREIGN PATENT DOCUMENTS

| | | | |
|---|---|---|---|
| JP | 06081531 | A * | 3/1994 |
| JP | 06158928 | A * | 6/1994 |
| KR | 1020090067498 | | 6/2009 |
| KR | 101018022 | B1 * | 3/2011 |
| KR | 1020110096744 | | 8/2011 |
| KR | 101184346 | | 9/2012 |

* cited by examiner

DOOR MORTISE LOCK

CROSS-REFERENCE TO RELATED APPLICATION

This application claims priority under 35 U.S.C. §119 to Korean Patent Application No. 10-2013-0025877 filed on Mar. 11, 2013, the disclosure of which is hereby incorporated by reference in its entirety.

BACKGROUND

1. Field

Embodiments of the inventive concept relate to a door mortise lock, and more particularly, to a door mortise lock which may prevent a safety-related accident such as a collision and damage to a lever located in an exterior from occurring when a user suddenly operates the lever by pulling the lever in a state where a dead bolt is not unlocked by enabling a latch bolt to be unlocked in a state where the dead bolt of the door mortise lock is completely unlocked.

2. Description of Related Art

A door lock installed at a door such as a front door includes a mortise that is provided in the door and performs a locking function and levers that are provided in an exterior and an interior of the door in order to operate the mortise.

In general, the mortise includes a latch bolt that operates due to the lever located in the exterior or the interior, a dead bolt that maintains the door in a locked state, and an electromotive or manual driving unit that operates the dead bolt.

When the door is to be opened in the exterior, the door may be opened by operating the dead bolt using a mechanical key, a password, a fingerprint, or the like to unlock the dead bolt and by operating the lever located in the exterior to unlock the latch bolt.

When the door is to be opened in the interior, the door may be opened by operating the dead bolt using an open switch provided in the interior to unlock the dead bolt and by operating the lever located in the interior to unlock the latch bolt.

However, a conventional mortise such as "a mortise that simultaneously unlocks a dead bolt and a latch bolt" disclosed in KR 2009-0067498 has problems of low product safety and low reliability because when a dead bolt and a latch bolt simultaneously operate to unlock the latch bolt, a door lock is easily unlocked, thereby making a user feel uncomfortable.

That is, in the conventional mortise, the latch bolt tends to be unlocked when the user suddenly operates a lever located in an exterior in a state where the dead bolt is not unlocked. In this case, since the dead bolt is not unlocked, when the user pulls the lever, a safety-related accident and damage to the lever may occur.

SUMMARY

Embodiments of the inventive concept provide a door mortise lock which may safely unlock a door lock and maximize product safety and reliability by enabling a dead bolt to completely operate and, after a time interval passes, a latch bolt to subsequently operate in order to unlock the door lock.

Embodiments of the inventive concept also provide a door mortise lock which may prevent a malfunction and maximize product quality by enabling a dead bolt and a latch bolt to sequentially operate in order to unlock a door lock.

In accordance with an aspect of the inventive concept, a door mortise lock includes: a dead bolt driving unit that operates a dead bolt; a latch bolt driving unit that unlocks a latch bolt when a time interval passes after the dead bolt is unlocked or retracted by the dead bolt driving unit; and a connection unit that is disposed between the dead bolt driving unit and the latch bolt driving unit, and selectively operates the dead bolt driving unit and the latch bolt driving unit so that the dead bolt and the latch bolt are sequentially unlocked with a time interval.

The dead bolt driving unit may include: a driving cam that rotates due to a dead bolt motor when unlocking information is input from a lever located in an exterior, and rotates due to the connection unit during a push operation and/or a pull operation of a lever located in an interior; an operation lever that is connected to the driving cam via a rod and moves to unlock the dead bolt when the driving cam rotates; and a gear unit that is connected to the connection unit such that the driving cam rotates due to the connection unit during the push operation and/or the pull operation of the lever located in the interior.

The connection unit may include: a rotating body that rotates due to the lever located in the interior and/or the lever located in the exterior; a connection lever that rotates about a first hinge at another side when the rotating body rotates; a driven rack that is pivotably coupled through a second hinge to one side of the connection lever and operates as the connection lever rotates; and a driving gear that meshes with the gear unit and rotates, as the driven gear operates, to rotate the driving cam.

The rotating body may include: a first rotating body that rotates counterclockwise during the push operation of the lever located in the interior and rotates clockwise during the pull operation of the lever located in the interior; and a second rotating body that rotates clockwise during a pull operation of the lever located in the exterior and rotates counterclockwise during a push operation of the lever located in the exterior.

The driving gear may include double gear units having different diameters, one of the double gear units may mesh with the driven rack, and the remaining one of the double gear units may mesh with the gear unit included in the dead bolt driving unit.

A projection may be formed on a lower portion of the connection lever, a mount unit on which the projection is mounted may be formed on the first rotating body, and the connection lever may rotate about the hinge at the another side when the projection is separated from the mount unit as the first rotating body rotates.

First and second operation cams that operate the latch bolt driving unit due to at least one rotation of the first rotating body before the dead bolt is unlocked or retracted by the dead bolt driving unit may be formed on the first rotating body, and third and fourth operation cams that operate the latch bolt driving unit due to at least one rotation of the second rotating body when a time interval passes after the dead bolt is unlocked or retracted by the dead bolt driving unit may be formed on the second rotating body.

The latch bolt driving unit may include: a projecting lever that rotates about a third hinge due to the first and second operation cams or the third and fourth operation cams; and a locking member that operates to unlock the latch bolt as the projecting lever rotates.

A projecting jaw by which the first operation cam or the third operation cam is caught may be formed on one side surface of the projecting lever.

BRIEF DESCRIPTION OF THE DRAWINGS

The foregoing and other features and advantages of the inventive concepts will be apparent from the more particular description of preferred embodiments of the inventive concepts, as illustrated in the accompanying drawings in which like reference characters refer to the same parts throughout the different views. The drawings are not necessarily to scale, emphasis instead being placed upon illustrating the principles of the inventive concepts. In the drawings.

DETAILED DESCRIPTION OF THE EMBODIMENTS

Figure 1:
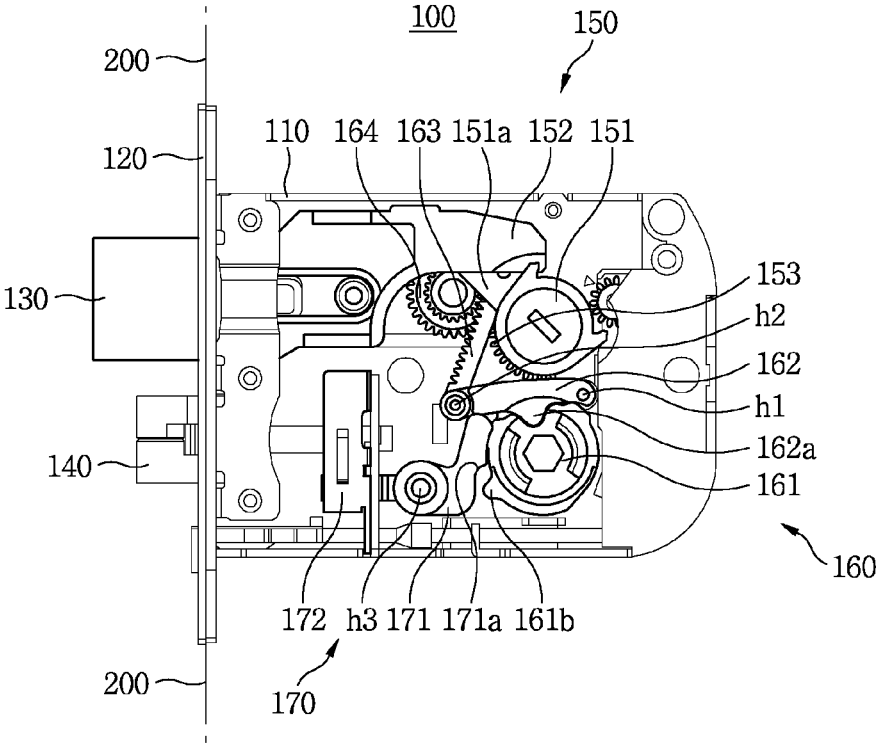
FIG. 1 is a cross-sectional view illustrating a door mortise lock according to an embodiment of the inventive concept.

Various embodiments will now be described more fully with reference to the accompanying drawings in which some embodiments are shown. These inventive concepts may, however, be embodied in different forms and should not be construed as limited to the embodiments set forth herein. Rather, these embodiments are provided so that this disclosure is thorough and complete and fully conveys the inventive concept to those skilled in the art. In the drawings, the sizes and relative sizes of layers and regions may be exaggerated for clarity.

It will be understood that when an element or layer is referred to as being "on," "connected to," or "coupled to" another element or layer, it can be directly on, connected, or coupled to the other element or layer or intervening elements or layers may be present. In contrast, when an element is referred to as being "directly on," "directly connected to," or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of the present inventive concept.

Spatially relative terms, such as "beneath," "below," "lower," "above," "upper," and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the present inventive concept. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, components, and/or groups thereof, but do not preclude the presence or addition of one or more other features, integers, steps, operations, elements, components, and/or groups thereof.

Embodiments are described herein with reference to cross-sectional illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
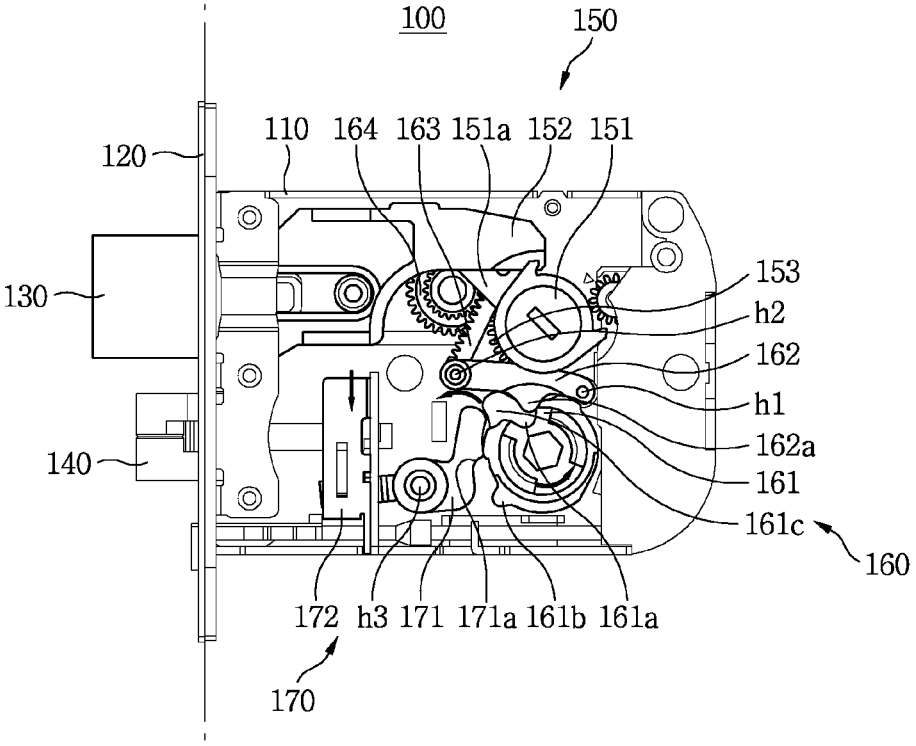
FIGS. 2 through 4 are cross-sectional views illustrating an operation of the door mortise lock during a push operation of a lever located in an interior.
Figure 3:
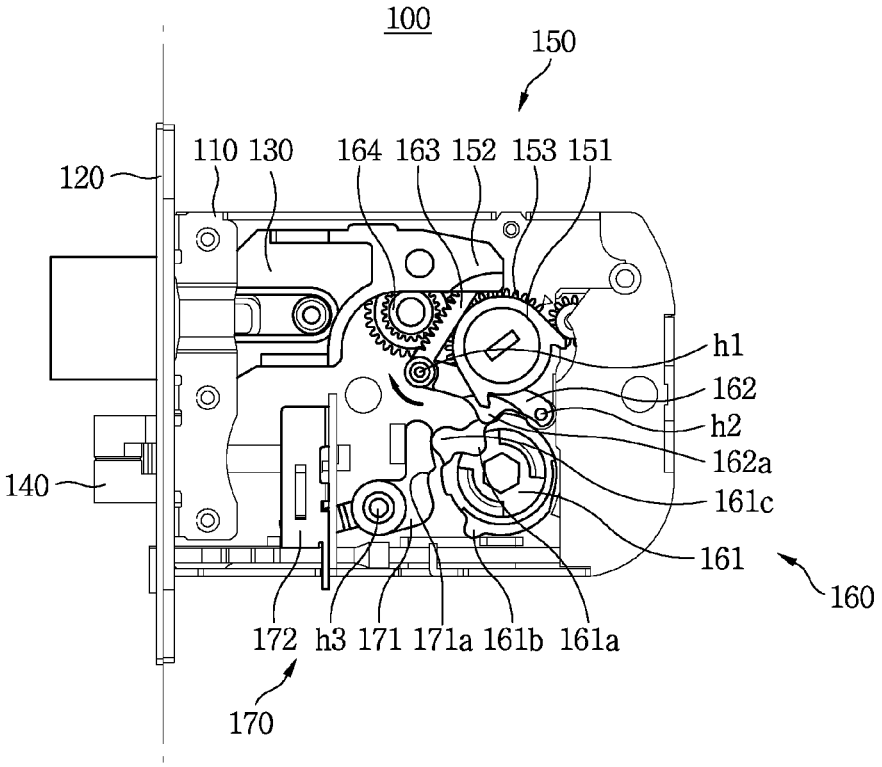
Figure 4:
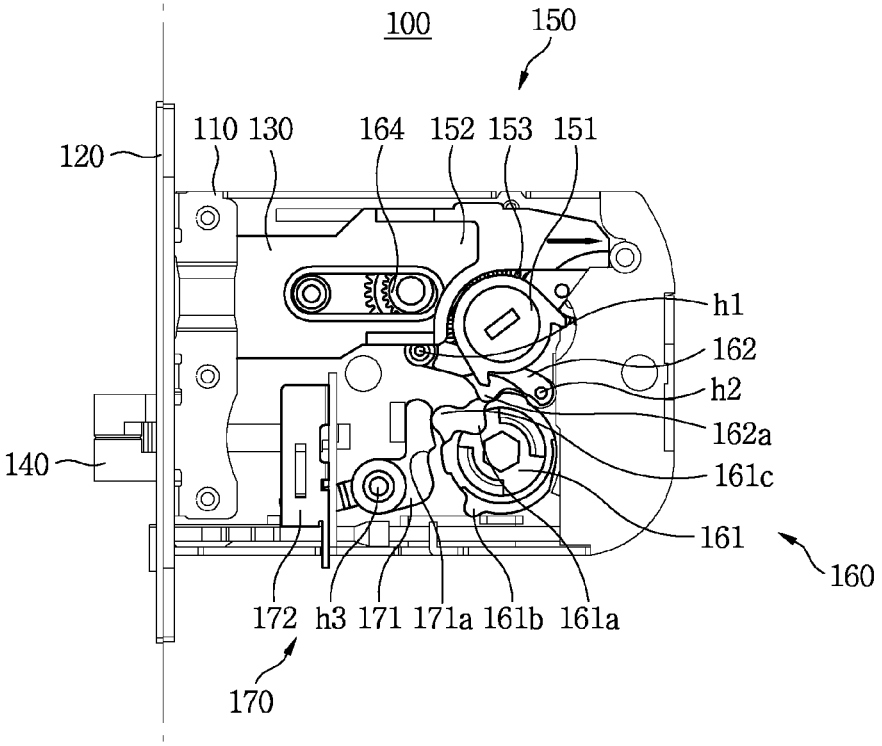
Figure 5:
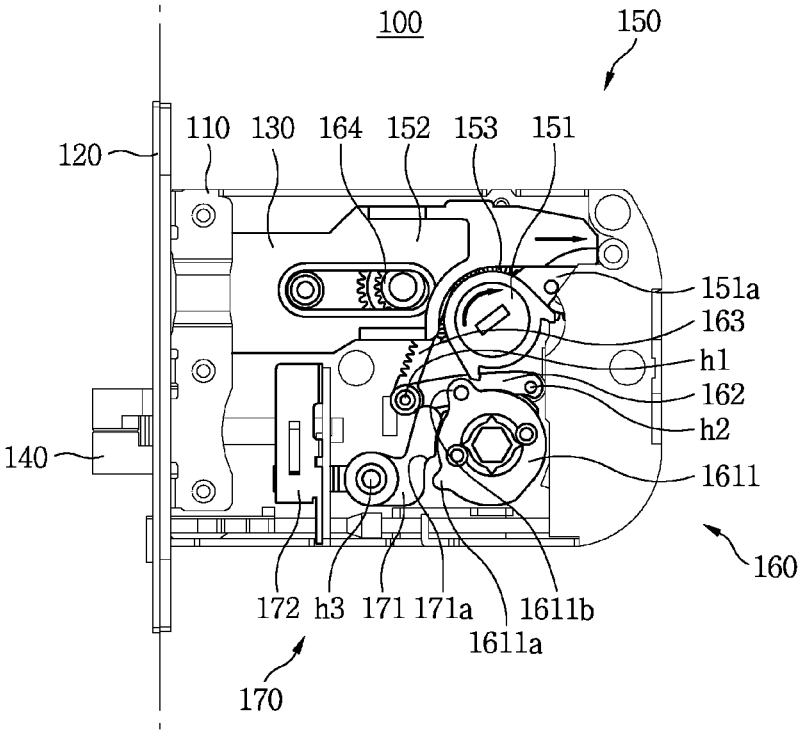
FIGS. 5 and 6 are cross-sectional views illustrating an operation of the door mortise lock during a pull operation of a lever located in an exterior.
Figure 6:
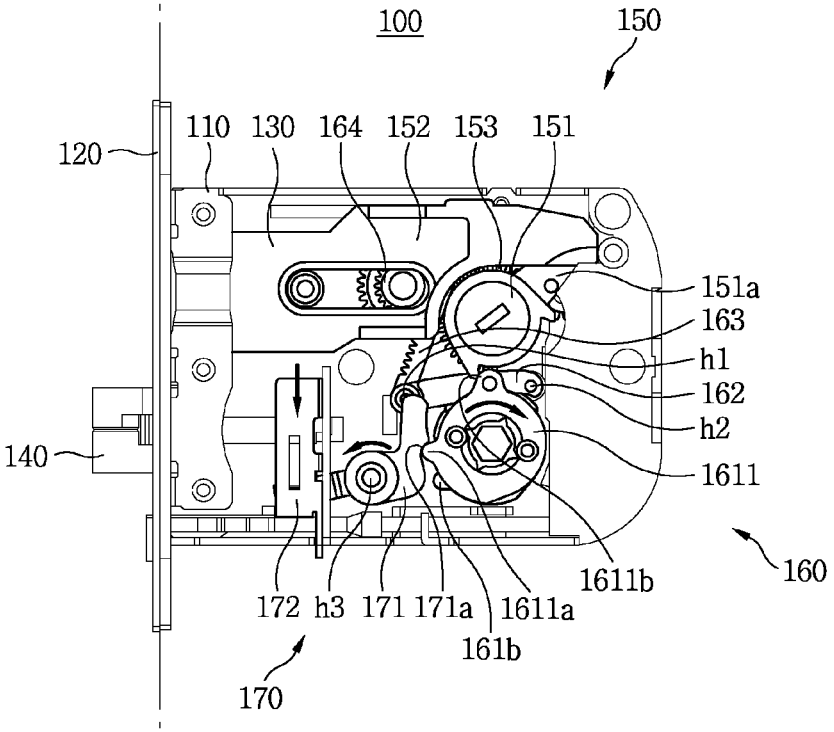

FIG. 1 is a cross-sectional view illustrating a door mortise lock according to an embodiment of the inventive concept. FIGS. 2 through 4 are cross-sectional views illustrating an operation of the door mortise lock during a push operation of a lever located in an interior. FIGS. 5 and 6 are cross-sectional views illustrating an operation of the door mortise lock during a pull operation of a lever located in an exterior.

Referring to FIGS. 1 through 6, the door mortise lock 100 includes a main body 110 that is provided in a door 200, a latch bolt 140 that is provided to lock and unlock the door 200 due to a lever (not shown) located in an interior and a lever (not shown) located in an exterior, and a dead bolt 130 that is provided to be locked and unlocked by a separate key, buttons, or an authentication process, like a general door mortise lock. The door mortise lock 100 further includes a dead bolt driving unit 150, a latch bolt driving unit 170, and a connection unit 160 that are provided to sequentially unlock the dead bolt 130 and the latch bolt 140 with a time interval.

The dead bolt driving unit 150 is formed in the main body 110 and operates the dead bolt 130 to lock and unlock the door 200. The latch bolt driving unit 170 unlocks the latch bolt 140 when a time interval passes after the dead bolt 130 is unlocked or retracted by the dead bolt driving unit 150. The connection unit 160 is disposed between the dead bolt driving unit 150 and the latch bolt driving unit 170, and selectively operates the dead bolt driving unit 150 and the latch bolt driving unit 170 so that the latch bolt 140 is unlocked before the dead bolt is unlocked or retracted by the lever located in the interior (not shown).

In this case, the dead bolt driving unit 150 includes a driving cam 151 that rotates due to a dead bolt motor (not shown) when unlocking information is input in a authentication process from the lever located in the exterior and rotates due to the connection unit 160 during a push operation of the lever located in the interior, an operation lever 152 that is connected via a rod 151*a* to the driving cam 151 and moves to unlock or retract the dead bolt 130 when the driving cam 151 rotates, and a gear unit 153 that is connected to the connection unit 160 such that the driving cam 151 rotates due to the connection unit 160 during a push operation of the lever located in the interior.

The connection unit 160 includes a rotating body that rotates due to the lever located in the interior and the lever located in the exterior, a connection lever 162 that rotates about a hinge h1 at another side when the rotating body rotates, a driven rack 163 that is rotatably coupled through a hinge h2 to one side of the connection lever 162 and operates as the connection lever 162 rotates, and a driving gear 164 that meshes with the gear unit 153 and rotates, as the driven rack 163 operates, to rotate the driving cam 151.

The driving gear 164 is configured to have double driving gear units having different diameters. One of the double gear units meshes with the driven rack 163 and the remaining one of the double gear units meshes with the gear unit 153 included in the dead bolt driving unit 150.

Also, the rotating body may include a first rotating body 161 that rotates counterclockwise during a push operation of a push-pull lever located in the interior or when a rotating lever located in the interior rotates counterclockwise, and a second rotating body 1611 that rotates clockwise during a pull operation of a push-pull lever located in the exterior or when a rotating lever located in the exterior rotates clockwise, or may include only one rotating body.

First and second operation cams 161*b* and 161*c* that operate the latch bolt driving unit 170 due to at least one rotation of the first rotating body 161 before the dead bolt 130 is unlocked or retracted by the dead bolt driving unit 150 are formed on the first rotating body 161. Third and fourth operation cams 1611*a* and 1611*b* that operate the latch bolt driving unit 170 due to at least one rotation of the second rotating body 1611 when a time interval passes after the dead bolt 130 is unlocked or retracted by the dead bolt driving unit 150 are formed on the second rotating body 1611.

A projection 162*a* is formed on a lower portion of the connection lever 162, and a mount unit 161*a* on which the projection 162*a* is mounted is formed on the first rotating body 161. Accordingly, when the projection 162*a* is separated from the mount unit 161*a* as the first rotating body 161 rotates, the connection lever 162 may rotate about the hinge h1.

The latch bolt driving unit 170 includes a projecting lever 171 that rotates about a hinge h3 due to the first and second operation cams 161*b* and 161*c* or the third and fourth operation cams 1611*a* and 1611*b*, and a locking member 172 that operates to unlock the latch bolt 140 as the projecting lever 171 rotates. A projecting jaw 171*a* by which the first operation cam 161*b* or the third operation cam 1611*a* may be caught is formed on one side surface of the projecting lever 171.

An operation of the door mortise lock 100 constructed as described above will now be explained.

As the connection unit 160 operates due to a push operation of the lever located in the interior and thus the dead bolt driving unit 150 and the latch bolt driving unit 170 operate, the dead bolt 130 and the latch bolt 140 are sequentially unlocked with a time interval.

That is, when the lever located in the interior operates by being pushed as shown in FIGS. 2 through 4, the first rotating body 161 included in the connection unit 160 rotates counterclockwise (leftward) due to a push operation of the lever located in the interior.

The projection 162*a* of the connection lever 162 mounted on the mount unit 161*a* of the first rotating unit 161 is separated from the mount unit 161*a* as the first rotating body 161 rotates, and the one side of the connection lever 162 is raised about the hinge h1.

Once the one side of the connection lever 162 is raised, the driven rack 163 rotatably coupled through the hinge h2 to the one side of the connection lever 162 is raised, the driving gear 164 meshing with the driven rack 163 is forced to rotate, and then the gear unit 153 meshing with the driving gear 164 is forced to rotate.

That is, since the driving gear 164 includes double gear units, one of the double gear units meshes with the driven rack 163, and the remaining one of the double gear units meshes with the gear unit 153 included in the dead bolt driving unit 150 when the driven rack 163 is raised, once the driving gear 164 rotates, the gear unit 153 rotates, the driving cam 151 connected to the gear unit 153 rotates, and thus the driving cam 151 slidably moves the operation lever 152 through the rod 151*a*, thereby unlocking or retracting the dead bolt 130.

Since the second operation cam 161*c* formed on the first rotating body 161 rotates as the first rotating body 161 rotates, the second operation cam 161*c* pushes the projecting lever 171 included in the latch bolt driving unit 170, and the projecting lever 171 rotates about the hinge h3 to operate the locking member 172, thereby subsequently unlocking the latch bolt 140 with a time interval.

That is, when a key is input to the key input unit of the lever located in the exterior, the dead bolt motor (not shown) operates, the driving cam 151 of the dead bolt driving unit 150 connected to the dead bolt 130 rotates, and the dead bolt 130 is unlocked or retracted by means of the rod 151*a*.

In this case, when a pull operation of the lever located in the exterior is performed, as shown in FIGS. 5 and 6, the second rotating body 1611 included in the connection unit 160 rotates clockwise (rightward) due to the pull operation of the lever located in the exterior, the third operation cam 1611*a* provided on the second rotating body 1611 pushes the projecting lever 171 to unlock the locking member 172, and thus the latch bolt 140 is unlocked due to the pull operation of the lever located in the exterior, thereby preventing a safety-related accident such as a collision or damage to the lever which occurs when a user suddenly pulls the lever located in the exterior in a state where the dead bolt 130 is not unlocked or retracted.

As can be seen from the foregoing, since a driving unit is formed on a dead bolt and a driven unit is formed on a latch bolt, and the dead bolt and the latch bolt are sequentially driven with a time interval by operating the driving unit and then operating the driven unit, the driving unit operates due to a driving motor, a connection unit operates due to the driving unit in a state where the driving unit completely operates, and then the driven unit connected to the connection unit operates. Accordingly, a malfunction of a door lock may be prevented and the door lock may be stably and accurately unlocked, thereby maximizing user convenience and reliability.

The foregoing is illustrative of embodiments and is not to be construed as limiting thereof. Although a few embodiments have been described, those skilled in the art will readily appreciate that many modifications are possible in embodiments without materially departing from the novel teachings and advantages. Accordingly, all such modifications are intended to be included within the scope of this inventive concept as defined in the claims. In the claims, means-plus-function clauses are intended to cover the structures described herein as performing the recited function, and not only structural equivalents but also equivalent structures. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A door mortise lock mounted in a door, the door mortise lock comprising:

a dead bolt driving unit that operates a dead bolt;

a latch bolt driving unit that unlocks a latch bolt when a time interval passes after the dead bolt is retracted by the dead bolt driving unit, when unlocking information is inputted from a lever located on an exterior of the door, and wherein the latch bolt driving unit unlocks the latch bolt before the dead bolt is retracted by the dead bolt driving unit when a push operation or a pull operation of a lever located on an interior of the door occurs; and a connection unit that is operatively connected to both the dead bolt driving unit and the latch bolt driving unit, and selectively operates the dead bolt driving unit and the latch bolt driving unit, wherein the dead bolt driving unit comprises: a driving cam that rotates due to a dead bolt motor when the unlocking information is inputted from the lever located on the exterior of the door, and rotates due to the connection unit during the push operation or the pull operation of the lever located on the interior of the door; an operation lever that is connected to the driving cam via a rod and moves to retract the dead bolt when the driving cam rotates; and a gear unit that is connected to the connection unit such that the driving cam rotates due to the connection unit during the push operation or the pull operation of the lever located on the interior of the door, and wherein the connection unit comprises: a first rotating body that rotates due to the push operation or the pull operation of the lever located on the interior of the door; a second rotating body that rotates due to a pull operation or a push operation of the lever located on the exterior of the door; a connection lever that rotates about a first hinge at a first side when the first rotating body rotates; and a driven rack that is pivotably coupled through a second hinge to a second side of the connection lever and rotates a driving gear as the connection lever is rotated about the first hinge, and wherein the driving gear meshes with the gear unit so as to rotate the driving cam when the driving gear is rotated by the driven rack.

2. The door mortise lock of claim 1, wherein the first rotating body rotates counterclockwise during the push operation of the lever located on the interior of the door and rotates clockwise during the pull operation of the lever located on the interior of the door; and the second rotating body rotates clockwise during a pull operation of the lever located on the exterior of the door and rotates counterclockwise during the push operation of the lever located on the exterior of the door.

3. The door mortise lock of claim 1, wherein the driving gear comprises double gear units having different diameters, one of the double gear units meshes with the driven rack, and the remaining one of the double gear units meshes with the gear unit included in the dead bolt driving unit.

4. The door mortise lock of claim 1, wherein a projection is formed on a lower portion of the connection lever, a mount unit on which the projection is mounted is formed on the first rotating body, and the connection lever rotates about the first hinge when the projection is separated from the mount unit as the first rotating body rotates.

5. The door mortise lock of claim 1, wherein first and second operation cams, formed on the first rotating body, operate the latch bolt driving unit due to at least one rotation of the first rotating body before the dead bolt is retracted by the dead bolt driving unit when the push operation or the pull operation of the lever located on the interior of the door occurs, and third and fourth operation cams, formed on the second rotating body, operate the latch bolt driving unit due to at least one rotation of the second rotating body when the time interval passes after the dead bolt is retracted by the dead bolt driving unit when the push operation or the pull operation of the lever located on the exterior of the door occurs.

6. The door mortise lock of claim 5, wherein the latch bolt driving unit comprises:

a projecting lever that rotates about a third hinge due to the first, second, third, or fourth operation cam; and a locking member that operates to unlock the latch bolt as the projecting lever rotates.

7. The door mortise lock of claim 6, wherein a projecting jaw by which the first operation cam or the third operation cam is caught is formed on one side surface of the projecting lever.

* * * * *